United States Patent [19]

Tega

[11] 4,175,379

[45] Nov. 27, 1979

[54] MACHINE FOR MAKING DECORATIVE CHAINS HAVING LINKS OF AT LEAST TWO DIFFERENT SHAPES OR SIZES

[76] Inventor: Ezio Tega, 2, Via Carpaccio, Arezzo, Italy, I-52100

[21] Appl. No.: 877,559

[22] Filed: Feb. 13, 1978

[30] Foreign Application Priority Data

| | | | |
|---|---|---|---|
| Feb. 11, 1977 | [IT] | Italy | 9335 A/77 |
| Jul. 29, 1977 | [IT] | Italy | 9529 A/77 |
| Jul. 29, 1977 | [IT] | Italy | 9530 A/77 |

[51] Int. Cl.[2] ..... B21L 11/00

[52] U.S. Cl. ..... 59/16; 59/25

[58] Field of Search ..... 59/1, 16, 18, 19, 22, 59/23, 24, 25; 219/51, 52

[56] References Cited

U.S. PATENT DOCUMENTS

| | | | |
|---|---|---|---|
| 1,340,639 | 5/1920 | Weinacker | 59/25 |
| 1,818,111 | 8/1931 | Wirth | 59/16 |
| 1,878,860 | 9/1932 | Koenig | 59/16 |

FOREIGN PATENT DOCUMENTS

| | | | |
|---|---|---|---|
| 600806 | 8/1934 | Fed. Rep. of Germany | 59/25 |

*Primary Examiner*—Francis S. Husar
*Assistant Examiner*—Gene P. Crosby
*Attorney, Agent, or Firm*—Hopgood, Calimafde, Kalil, Blaustein & Lieberman

[57] ABSTRACT

The invention contemplates a single machine comprising two different wire feed systems and two different link-forming counter-pliers systems, each unique to a preselected different link size and/or shape, and a shuttle-borne counter-pliers unit is caused to cooperate, in a preselected program pattern, with one or with the other of the pliers systems (and associated wire-feed system), whereby the cumulative chain assembly of differently sized and/or shaped links may be developed in accordance with the pattern of shuttle operation.

17 Claims, 21 Drawing Figures

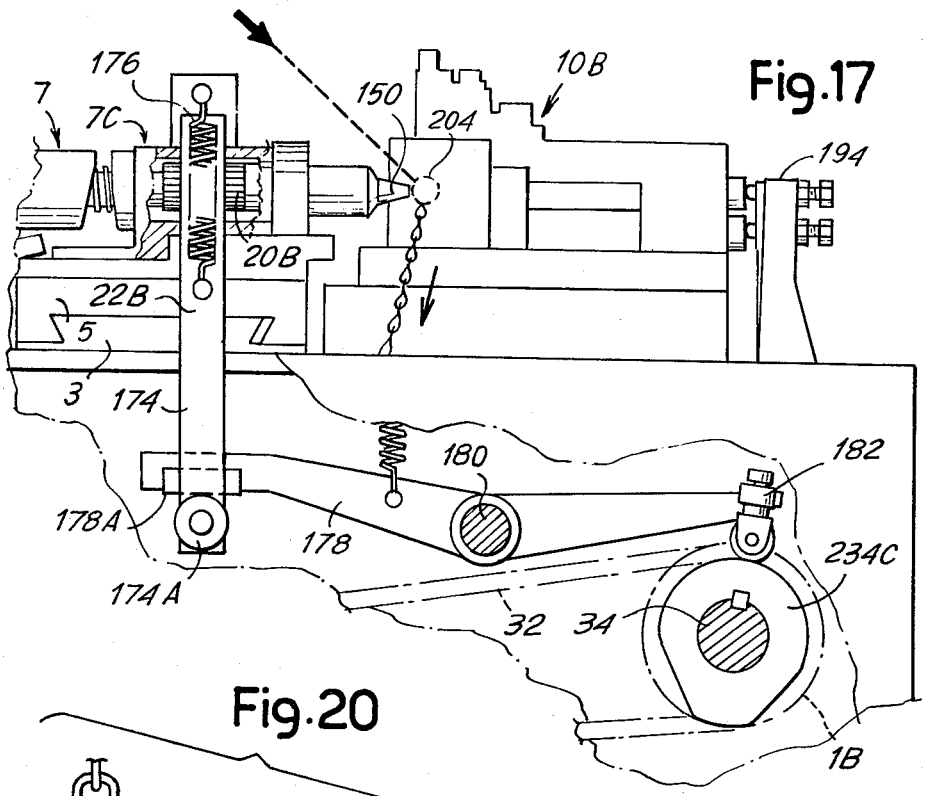
Fig.17
Fig.20
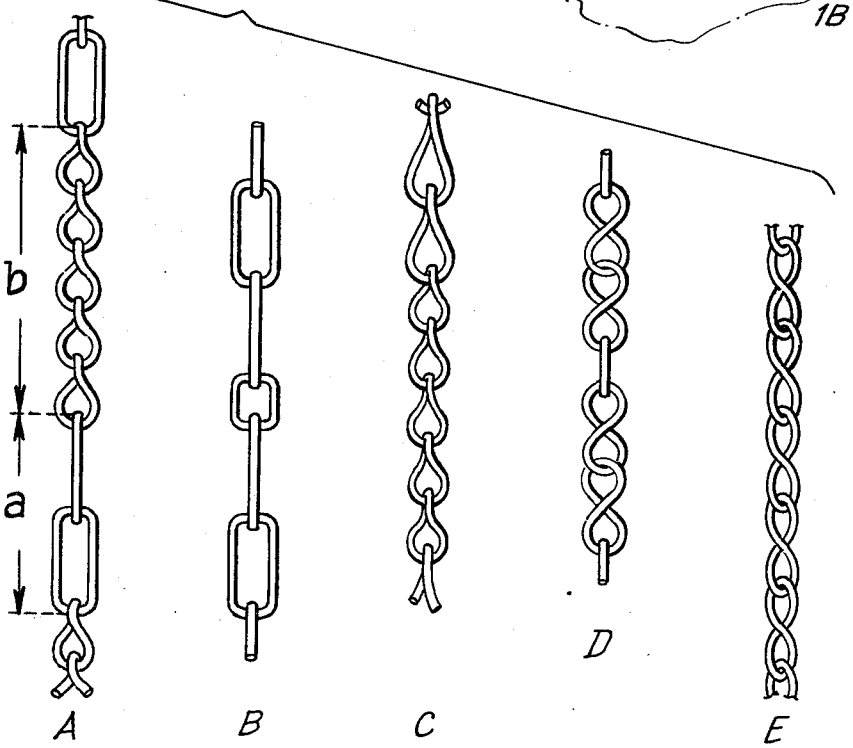

MACHINE FOR MAKING DECORATIVE CHAINS HAVING LINKS OF AT LEAST TWO DIFFERENT SHAPES OR SIZES

The object of the invention is a machine designed for the forming of decorative chains.

The object of the invention is to set up chains having links of two different shapes and/or sizes that can be obtained according to a quickly and widely modifiable program.

The machine involves two feeder units of a wire-like material and a pliers unit designed alternatively to cooperate with one or the other of said units. According to the invention, the pliers unit is slidable between two cooperation positions with the two feeder units and the counter-pliers unit; said pliers unit is actuated by the movable end of a lever oscillating around a fixed axis which binds the other end thereof; moreover, said lever is temporarily coupled, through electric control means, with an actuation profile for the selective movement in one direction and in the other direction of said oscillatory lever. Finally additional stroke end control means of the pliers unit are provided to determine the insertion of an actuating drive of one or the other of two cam control units or groups in function of the position reached by the pliers unit.

The machine may include electric controls to preset the disengagement of said drives, the disengagement being operated by cam means on the clutch or insertion drive shaft.

In practice the oscillatory lever may present two movable units, controlled by respective electromagnets and provided with feeler rollers designed to be alternately and temporarily located into a cooperation position with a double symmetrical cam, which determines the alternative movement, in the two directions, of the oscillatory lever.

Advantageously it may also be provided that the slide carrying the pliers unit may present two oppositely projecting pins, each designed to act on a respective oscillatory retaining tooth, which in the rest position disengages the drive, while said tooth—when it is moved by the pin—releases a movable unit of the member operated by the clutch, which thus is resiliently stressed for the coupling.

The invention will be better understood following the specification and the accompanying drawing, which illustrates an embodiment not restricting the same invention. In the drawing:

FIG. 17 illustrates a section taken along the line XVII—XVII of FIG. 2;

FIG. 20 shows some types of chains that can be obtained by the machine;

Figure 1:
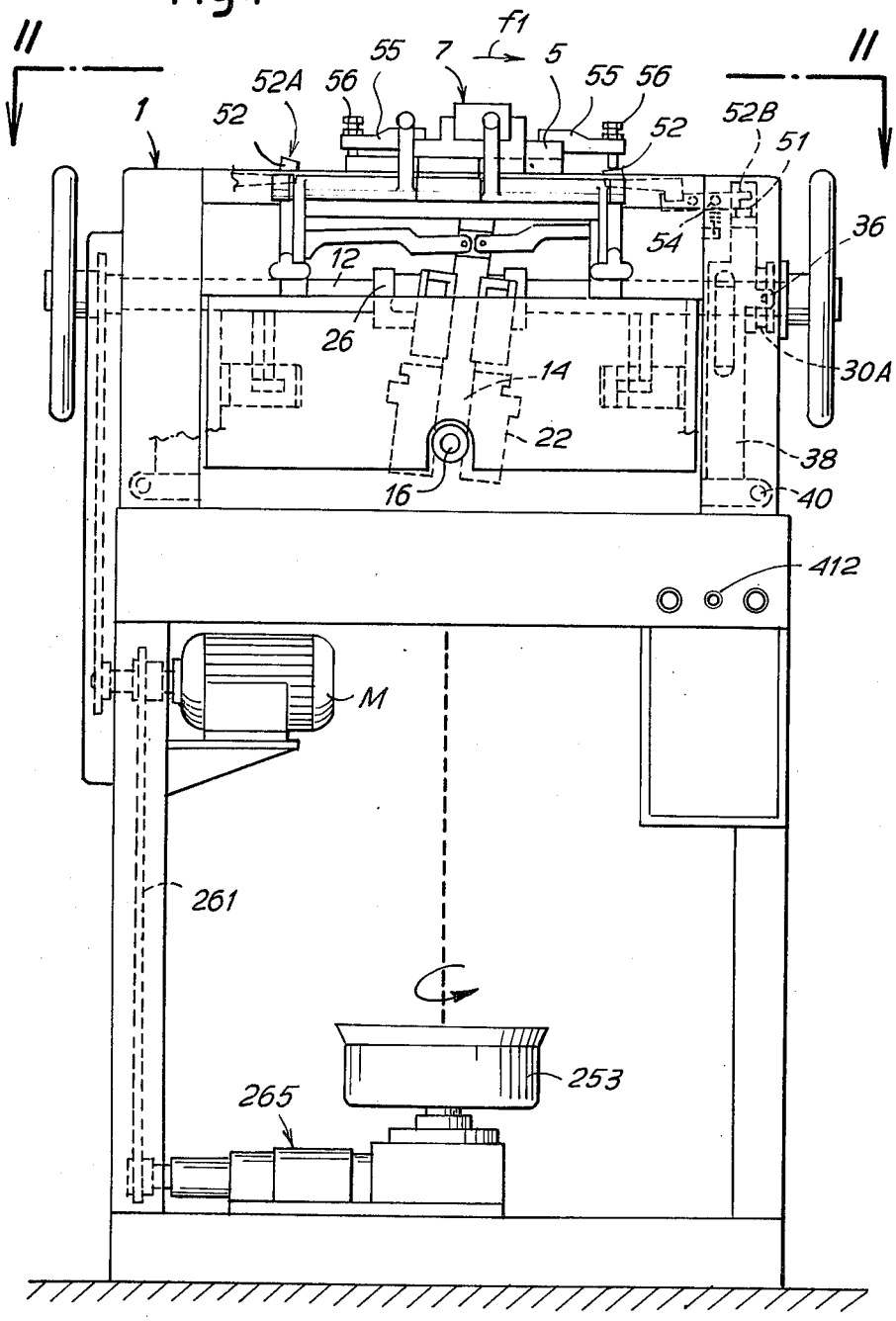
FIG. 1 illustrates an overall elevational view.

1 denotes generically a main frame of the machine, on which a sliding way 3 is upperly and transversally formed for a slide 5 that can be moved in the one or in the other of two working positions of a pliers unit 7, which is borne by said slide 5. The two final positions that can be reached by the unit 5, 7 allow to bring the pliers unit 7 to cooperate with the one or the other of two feeder units 9A, 9B, which are opposite, and with one or the other of two units of counter-pliers 10A, 10B located side by side and restrictedly spaced from each other, for the feed and respectively the shaping of the wire designed to the forming of two types of links for chain, which are machined with the cooperation of the unit 7. The two units 9A, 10A and the ones 9B, 10B and the unit 7 are per se known in the art and set up in several manners according to the type of chain which is required; the assembly of the members which are connected to the units 9A, 9B; 10A, 10B and to the pliers unit 7, are not described in detail, except what is hereinafter hinted. Hereinafter the means will be described designed in order that the pliers 7 reach the working position with the one or the other of the units 9A, 10A and 9B, 10B, as well as the means providing for the actuation of the respective units in a prompt manner when these units have to operate together with the pliers unit 7 which is presented in front thereof.

The motion is picked up from a drive shaft 12 in the way hereinafter indicated. The same drive shaft 12 serves for the power take-off designed for the movement of the slide 5 in the one or the other of the two positions which it has to reach, and to control, by means of two clutches, two substantially symmetrical portions, which serve for the forming of two different types of links.

In order to obtain the movement of the slide 5, an oscillatory lever 14 is provided and said lever is bound with its own upper end in 15 in a suitably articulated and slidable manner to the slide 5, and with its own lower end is articulated in 16 to the frame 1. The lever 14 has a central expanded portion 14A in which two seats are made to engage two corresponding square levers 18 articulated in 20 to the lever 14; each of the two small square levers 18 has an arm 18A operated by a corresponding electromagnet 22, which passing from an energization position into a de-energization position determines an angular movement of the respective small square lever 18, to locate a corresponding roller feeler 24 into and out of the working position, said roller being arranged at the upper end of the corresponding lever 18. The two roller feelers 24 are located in front of the shaft 12 and in correspondence of a double cam 26, having a symmetrical development and presenting on its own cylindrical surface two symmetrical channels which have a substantially helical development and terminal zones; the corresponding feeler 24 can be inserted and disengaged in any easy manner in each channel. When one of the feelers 24 is located by the corresponding electromagnet 22 in the active position in the corresponding channel of the cam 26, it is engaged between the banks of the channel and with the rotation of the cam 26 together with the drive shaft 12; provided with a continuous motion, is moved substantially according to the axis of the shaft 12; in this manner the angular movement of the oscillatory lever 14 around the axis 16 is determined for the movement from an inclined position to the opposite one. The movement in the contrary direction to the one now considered is obtained when the other of the electromagnets is energized and the other corresponding feeler 24 is located in the working position. After a feeler has determined the desired oscillation stroke of the oscillatory lever 14, the prompt de-energizing of the electromagnet 22 and the intervention of an elastic antagonist means, not illustrated (or of another equivalent means) determines the disengagement from the cam 26 of the feeler 24, which has determined the movement—by means of the cam 26—and lever 14 remains in the position attained, having entrained the slide 5 and thus the pliers unit 7 into the desired working position, locating the latter in front of the one or the other of the two units 9 and 10.

In synchronism with the movement of the slide 5 and thus of the unit 7 from one position into the other by means of the lever 14 and thus of the controls by the electromagnet 22, the start of one of the units 9A, 10A, respectively 9B, 10B and the stop of the other are to be determined. For this purpose, controls which are of the mechanical type, serve to determine the insertion or clutching of the drive and thus the start of the movement of one of the two units in the instant in which the slide 5 and the unit 7 are positively located in front of said unit, while appropriately synchronized electrical control means determine the disengagement of the drive pertaining to that of the units which must cease its working.

In order to obtain the insertion movement there is provided a clutch or insertion unit generically denoted by 30 on each side of the machine that is, on each side of the frame 1; the insertion member or clutch 30 assembled on the relevant end of the shaft 12 is designed to determine the operation of a drive including a chain 32 in order to reach a corresponding semi-shaft 34 parallel to the one 12 and designed to determine the movements in the corresponding unit 9A and 10A, respectively 9B and 10B; the two semi-shafts 34 are each developed for the half of the front of the machine or for a portion of the half of the machine front. Each semi-shaft 34 carries several per se known cams cooperating with respective levers for the control of the several members, among which those denoted by 9A, 9B, 10A, 10B; also these control levers or the like are not particularly illustrated and described because they are of a known type for those skilled in the art, as shown for example in Spanish Patent No. 457,319 and U.S. patent application Ser. No. 781,971 of Mar. 28, 1977, now U.S. Pat. No. 4,127,987, both of the same applicant.

At each end of the shaft 12 there is provided a front tooth clutch 30, which may have a single seizing position, when this is required for given control requirements of the respective unit 9A, 10A or 9B, 10B. The clutch includes a drive member 30A, which is also slidable on the shaft 12 and having an angular seizing therewith, and a driven member 30B which is idle on the shaft 12 and integral to a wheel for chain 30C for the chain 32. Spring means 30D tend to urge the drive member 30A into seizing with the driven member, while, by means of an annular race 30E of the same member 30A, the latter may be operated to move away that is for the disengagement; besides the rigid teeth 30F of the clutch, the drive member 30A has a resilient tooth 30G which serves to accompany the driven member 30B nearly to the end of the disengagement stroke and avoid any shifts. In the race or groove 30E there are engaged two rollers or slippers 36 borne by a fork lever 38, articulated in 40 lowerly on the frame 1 and capable of angular movements to determine the insertion and disengagement movements of the respective clutch 30. The fork lever 38 has a seat for a small square lever 42 articulated in 44 and capable of being operated by an electromagnet 46, assembled on the fork lever 38. This electromagnet may move the upper end 42A of the small lever 42 into a moved away position and respectively into a more approached and active position with respect to the shaft 12; the square lever carries at said upper end 42A, a roller feeler 48 which when approached to the shaft 12 is capable of cooperating with a front cam 50, assembled on the shaft 12 and constantly rotating therewith. Thus the control of the electromagnet 46 will allow to activate the feeler 48; when this feeler 48 is located in correspondence of the trajectory of the cam 50, it determines the movement of the fork lever 38 around the axis 40 as soon as and in the instant in which on the feeler 48 the projecting portion of cam 50 acts, in a perfect alignment with the shaft 12. This movement determines the disengagement of the clutch 30 against the action of the resilient antagonist means which urge the insertion or engagement movement.

The disengagement condition of each clutch 30 is stabilized by a mechanical retaining system which is affected by the slide 5. The lever 38 presents a stop 51, with which an end tooth 52B cooperates, formed by a small square lever 52 oscillating around a pin 54. The fork levers 38 at the opposite ends of the machine are two for the two drive clutches 30 and two are the small levers 52 and both levers are aligned with corresponding extensions 55 which at the ends carry corresponding pins 56, capable of acting on the inclined end surface 52A of the respective lever 52. When the slide is moved in a given direction, the pin 56 on the side towards which the slide is moved, acts at a certain point at the end of the stroke of the slide 5 on the inclined surface 52A determining a movement of the lever 52 around the pin 54, to which the lifting of the tooth 52B corresponds, which tooth had remained seized by the stop 51 in the disengagement arrangement. Under these lifting conditions of the tooth 52B, the fork lever 38 is released (i.e., the abutment stop 51 of lever 38 is shifted) tooth 52B, and the resilient means determines the coupling of the respective clutch 30 in the already described manner, to cause the actuation of the respective chain and semi-shaft 34. When the slide 5 is moved in the direction contrary to the aforesaid one, and thus the pin 56 moves away from the respective small lever 52, the tooth 52B tends to be re-lowered elastically by effect of a spring 52E and is thus ready to be again in limiting abutment with the stop 51, as soon as the lever 38 will have been moved in the direction of disengagement of the respective clutch 30, by means of the cam 50 which will promptly act on the feeler 48, which in the meanwhile will have been inserted in the working position by energization of the electromagnet 46; after the cam 50 has ceased its own thrust in the clockwise direction on the lever 38, and the latter tends by means of the elastic means 30D to re-approach the two members of the clutch, the stop 51 will be caused to lie on the tooth 52B again under the disengagement conditions, until a new action of the slide 5 will have caused again the lifting of the tooth 52B and thus the release of the lever 38 and the coupling of the clutch.

The actuation of one or of the other of the two units 9A, 10A or 9B, 10B is obtained by the mechanical control of the means 54, 56 and 52, 52B which actuate the clutch and thus the respective semi-shaft 34, while the disengagement is obtained by presetting through the electromagnet 46 and by appropriately synchronized control by the cam 50.

Each of the semi-shafts 34 bearing the cams is combined with a device to lock the same shaft in a wall defined angular position. This device includes a tooth 101 on a wheel 103 locked on the shaft 34 in question; adjacent the wheel 103 there is assembled a small lever 105 articulated with a slot 107 to a fixed pin 109; the lever is returned by a spring 110 in such a manner as to lie with a tappet roller 112 on an inclined surface 114A of a small block 114 borne by the machine frame; the lever 105 carries a stationary tooth 116 and an oscillating tooth 118, which oscillates around a linkage 118A and urged by a spring 120. When the chain 32 ceases to positively operate the respective shaft 34, by effect of inertia or other stresses, the tooth 101 arrives to urge the oscillatory tooth 118 to the interior and thus to exceed it striking the tooth 116, while the lever 105 is urged downwardly by the spring 110 by reaction between the inclined profile 114A and the roller 112; as soon as the tooth 101 has passed the tooth 118, it contacts the tooth 116, while the tooth 118 trips behind the same tooth 101, which thus remains engaged between the teeth 116 and 118. If the inertia is small and if the reactions of the tappets acting on the cams of the shaft 34 are restricted the shaft 34 remains locked, otherwise it tends to lift the lever 105 overcoming the action of the spring 110, until it is braked and returned into the position imposed by the spring 110, by the profile 114A and by the upper end of the slot 107. Upon a subsequent start, the tooth 101, entrained in rotation, lifts the lever 105 which moves away along the profile 114A to the release of the tooth 101 from the tooth 116.

When the slide 5 reaches one of the two working positions by control of the lever 14, it must be locked against the additional movements with respect to the way 3. For this purpose, towards each end of the way 3, where the slide 5 arrives, there is provided a stopping tooth 130, which is urged by a spring 132 to penetrate into a housing of the slide for the locking thereof. The unlocking of the tooth 130 is effected by action on a feeler 134 of the tooth 130 by a corresponding bar 136 which is slidable and carries a control profile of the feeler 134 and is urged in a direction by a spring and in the opposite direction it may be urged by an extension 38F of the corresponding fork lever 38. The locking and unlocking of the slide 5 is thus synchronized with the movements of the levers 38 for the control of the clutches 30.

Although the pliers 7, the feeders 9A and 9B and the counter-pliers 10 with the associated shearing knives are all known members for those skilled in the art, some members of these devices will be briefly described.

The pliers 7 include two end jaws 150 which are closed by spring means 152 acting on one stem 154, on which a square 156 acts under the action of a tappet 158, on its turn operated by means of a lever 159 by one of the cams of the respective semi-shaft 34. The pliers 7 may be advanced axially and taken back by a lever 160 which acts on the unit 162 of the pliers against the action of a return spring 164. The pliers 7 in the whole may be angularly raised with respect to the slide 5, as it is articulated in 165 to the slide 5; the lifting and the lowering are controlled by respective levers 166, which act by actuation of respective cams of the shafts 34, to act by means of tappets 168 on one or the other of set or register members 170 borne by the pliers unit 7 oscillating around the linkage 165. The lifting of the pliers 7 is actuated in order to allow the pick-up of the wire by one or the other of the members 9A, 9B; the lowering of the slide 7 is actuated in order to allow the cooperation thereof with one or the other of the members or counter-pliers 10A, 10B. The internal slidable unit 162 of the pliers 7 is capable of being rotated by action on a set of teeth 172 by means of a rack 174 vertically slidable in the slide unit. This rack is urged upwardly by a spring 176 and may be lowered by the action of one or the other of two levers 178, operated by cams borne by the two semi-shafts 34. These levers 178 are each designed to lower the rack 174, when with the movement of the slide, the one or the other of two lower rollers 174A of said rack is located under the bracket end 178A of the considered lever.

Figure 6:
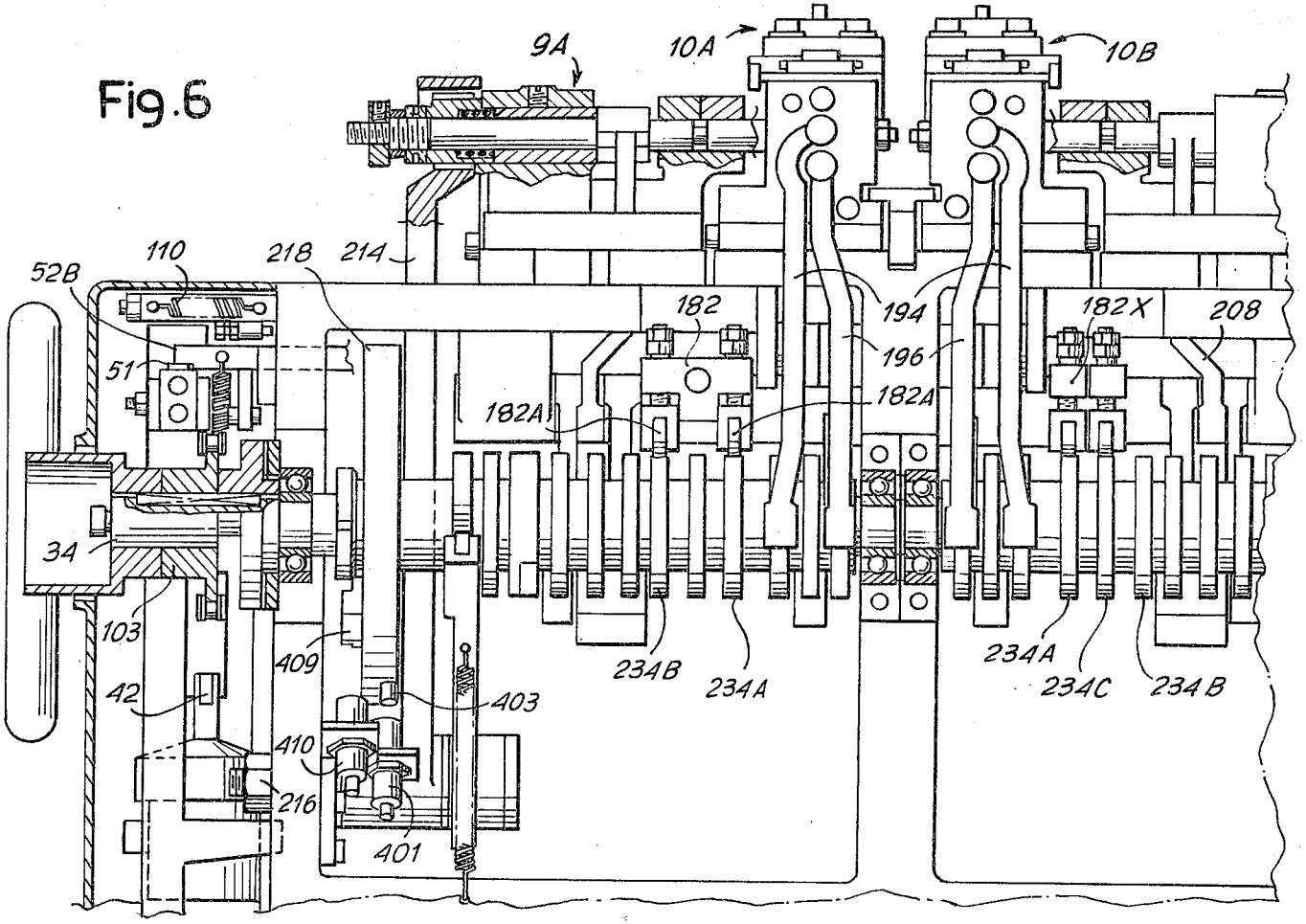
FIGS. 6 and 7 illustrate two partial views taken along the lines VI—VI and VII—VII of FIG. 2.
Figure 7:
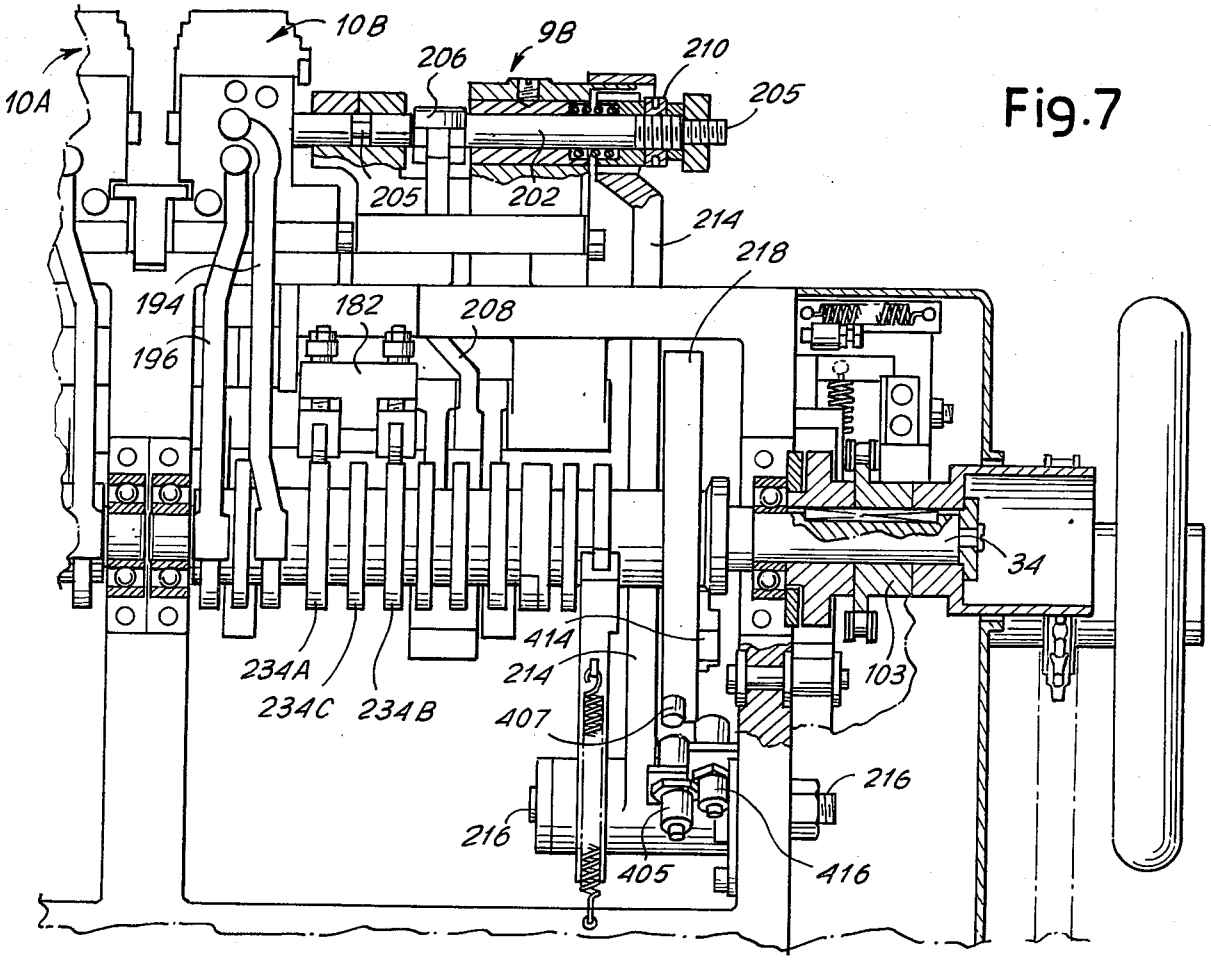
Figure 8:
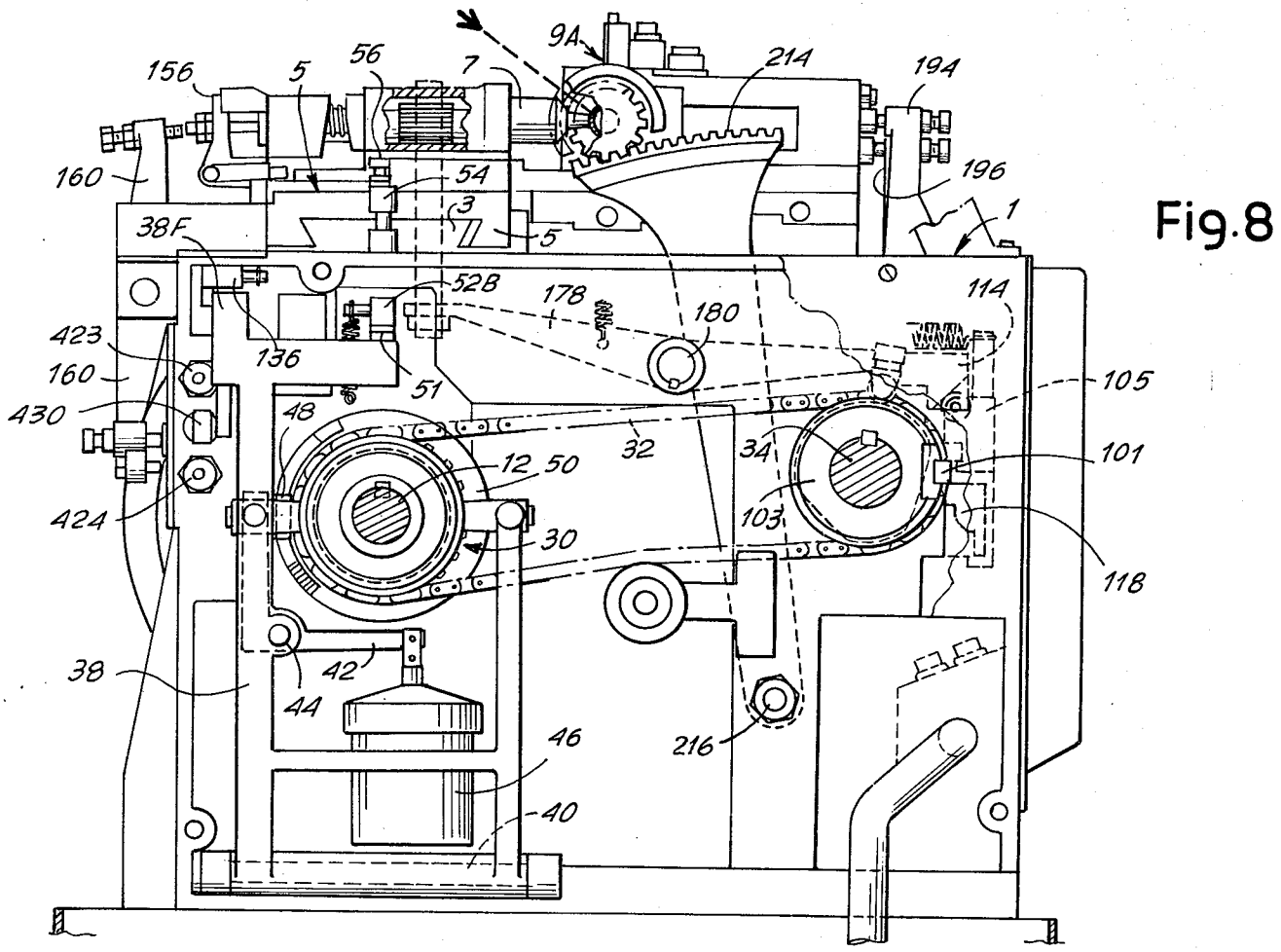
FIGS. 8, 9 and 10 illustrate a view taken along the line VIII—VIII of FIG. 2 with sectioned portions and two details enlarged and more sectioned of said FIG. 8.
Figure 9:
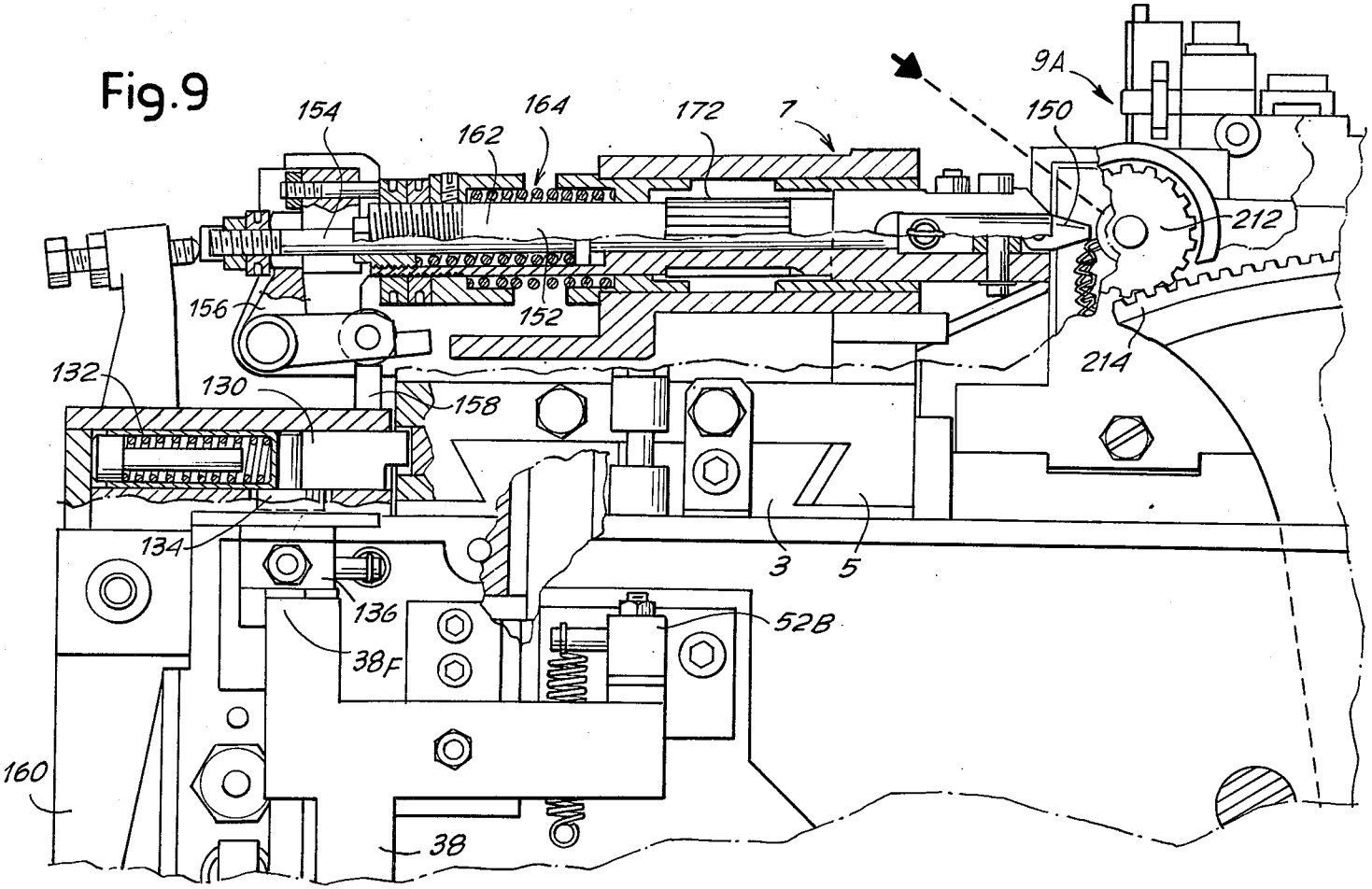
Figure 10:
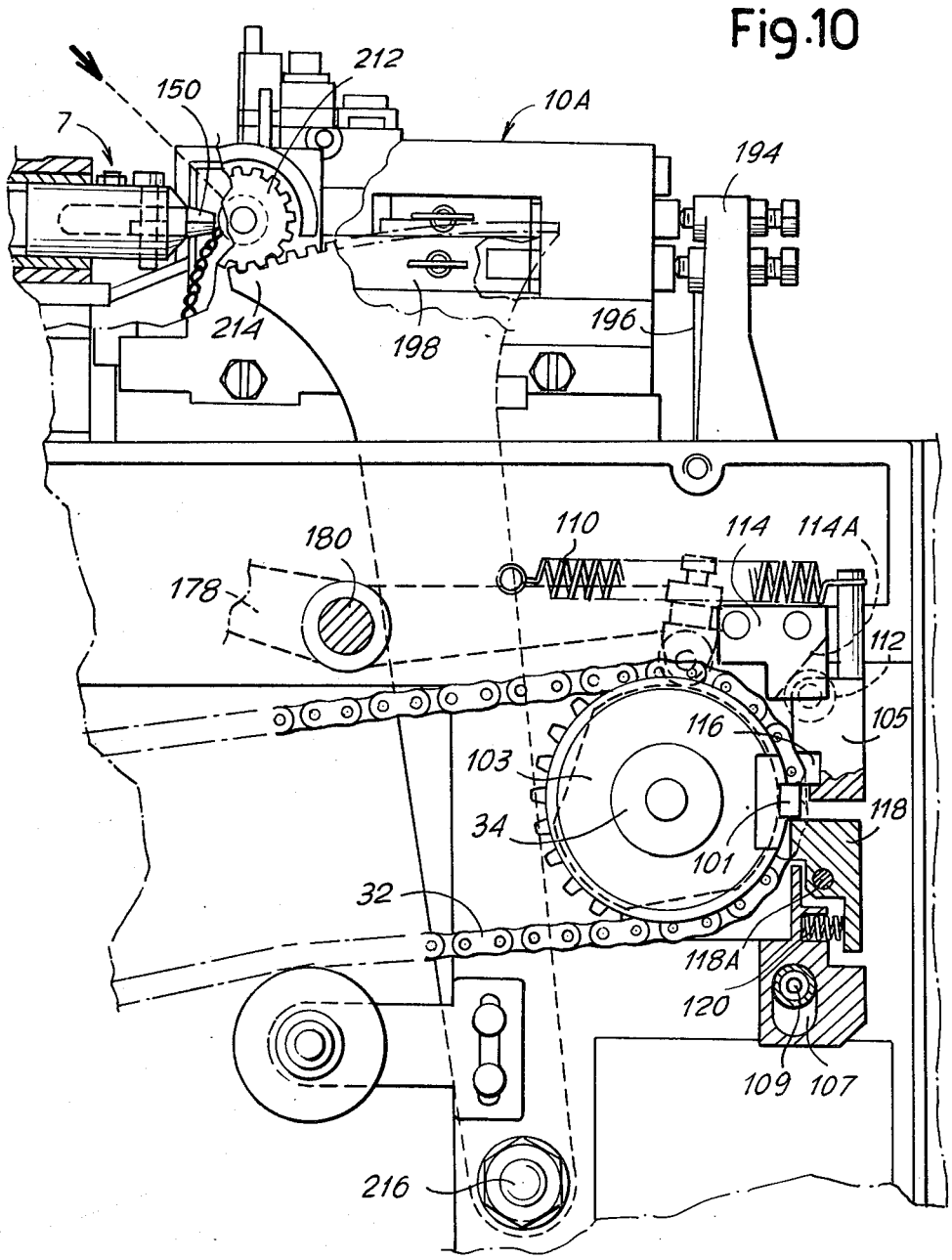
Figure 11:
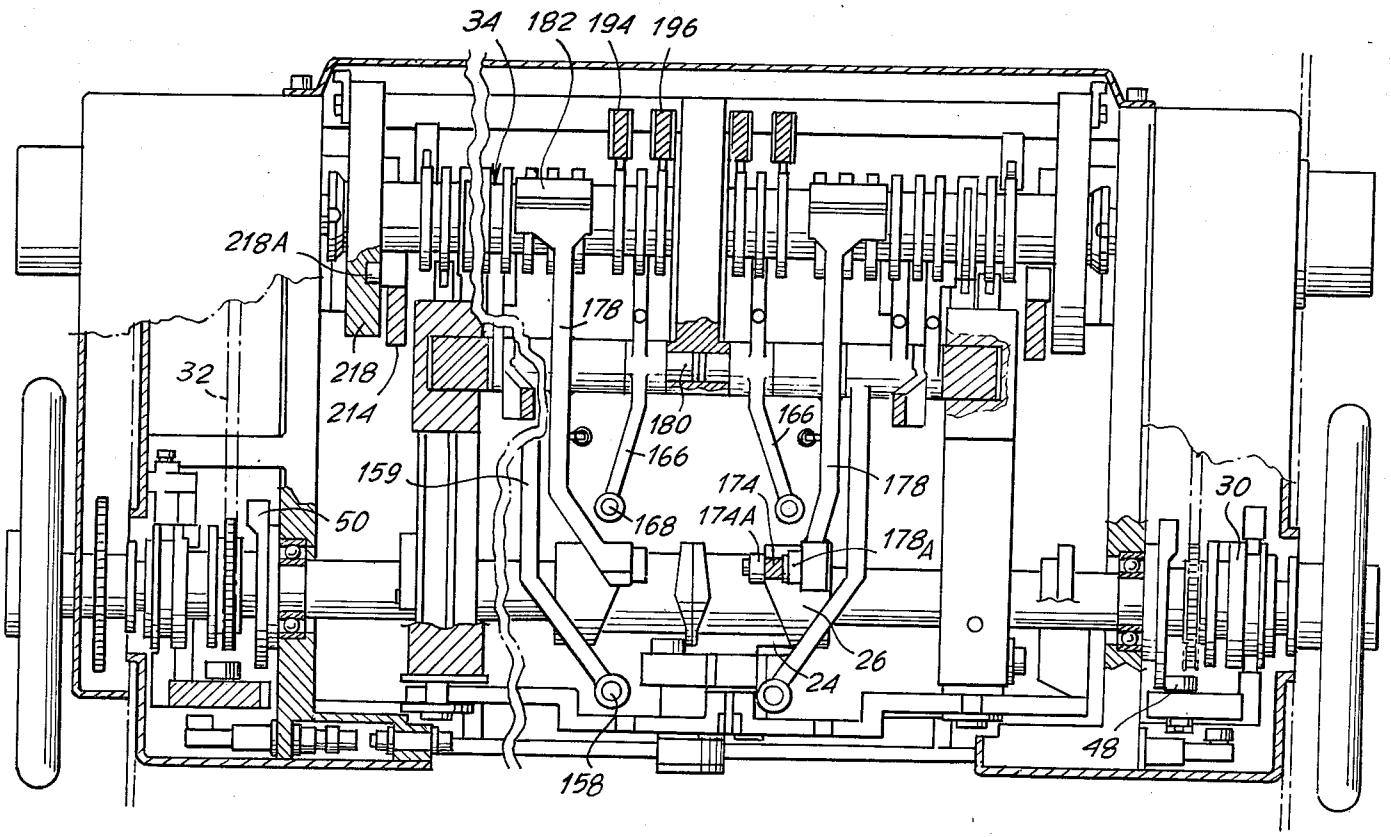
FIG. 11 illustrates a view and a partial section taken along the line XI—XI of FIG. 5.
Figure 12:
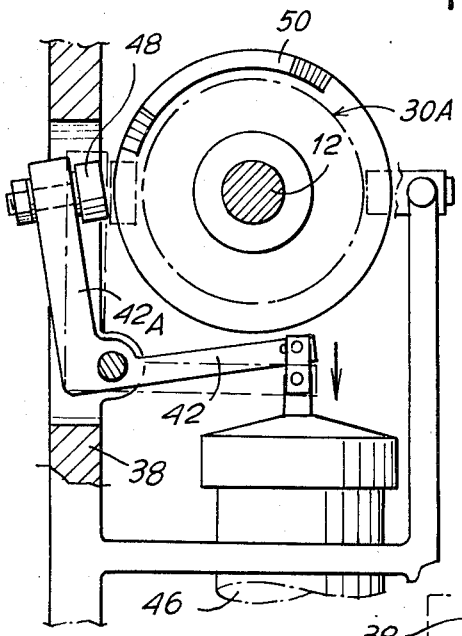
FIG. 12 illustrates a local section taken along the line XII—XII of FIG. 5.
Figure 13:
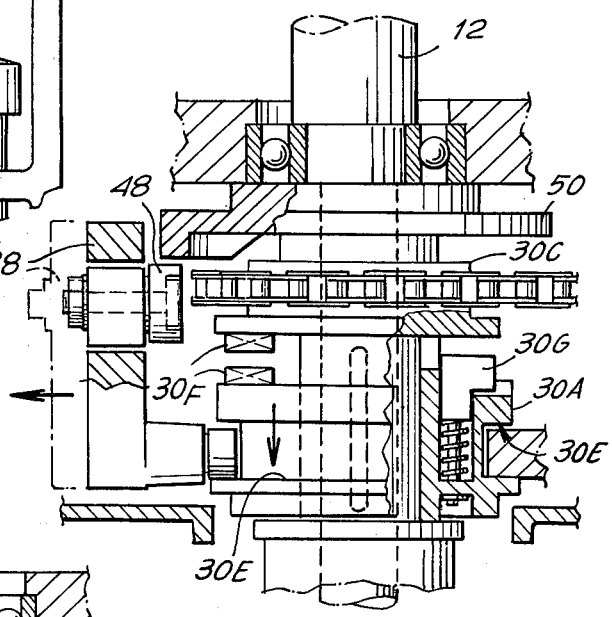
FIGS. 13 and 14 are views taken along the line XIII—XIII of FIGS. 5 and 12 showing an insertion in two arrangements.
Figure 14:
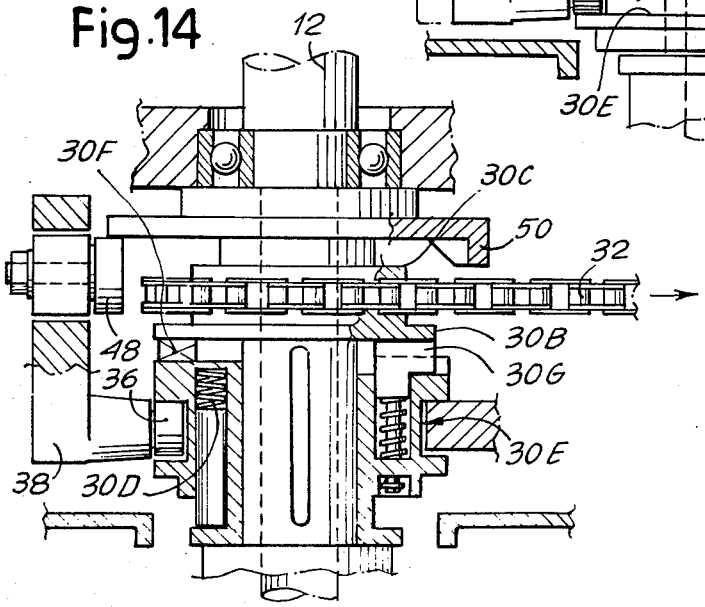
Figure 16:
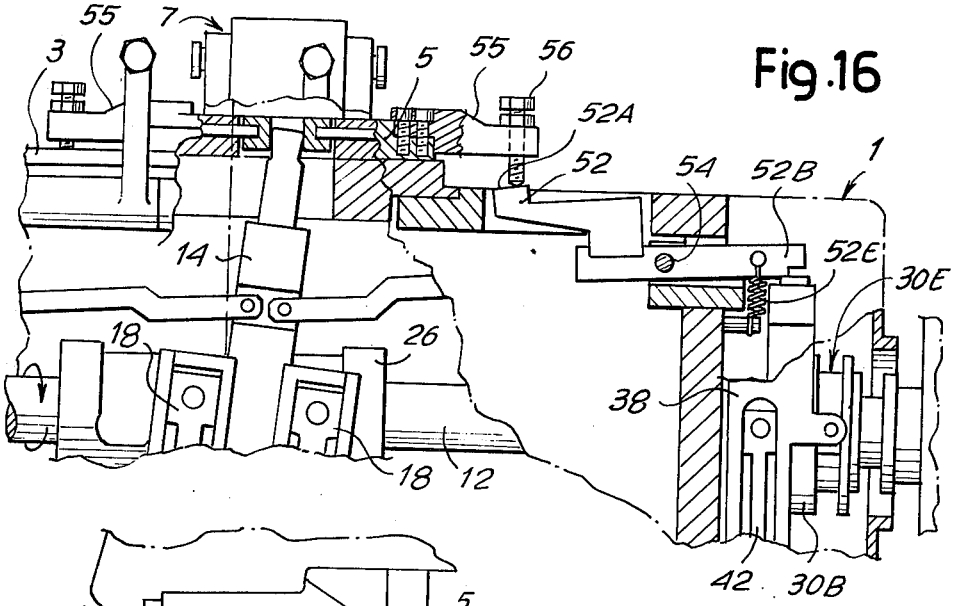
FIG. 16 illustrates a partial section taken along the line XVI—XVI of FIGS. 2 and 4.
Figure 15:
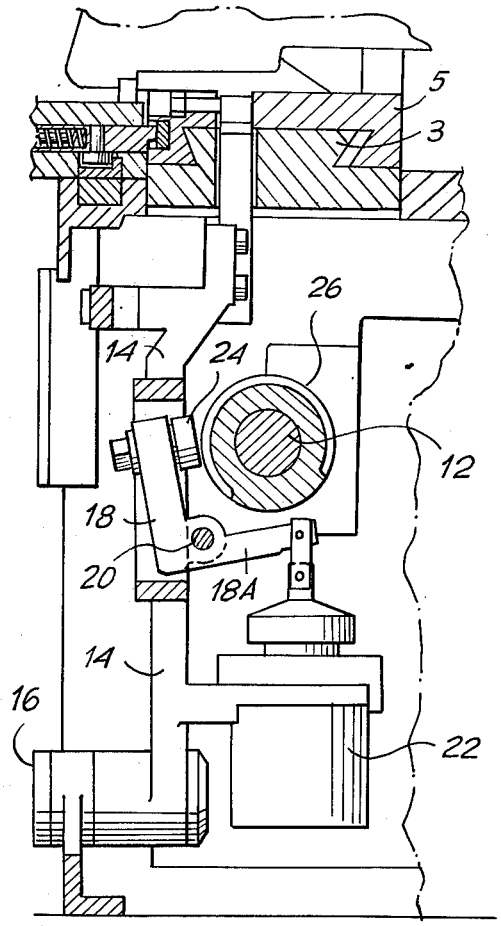
FIG. 15 is a detail in section taken along the line XV—XV of FIG. 5.
Figure 18:
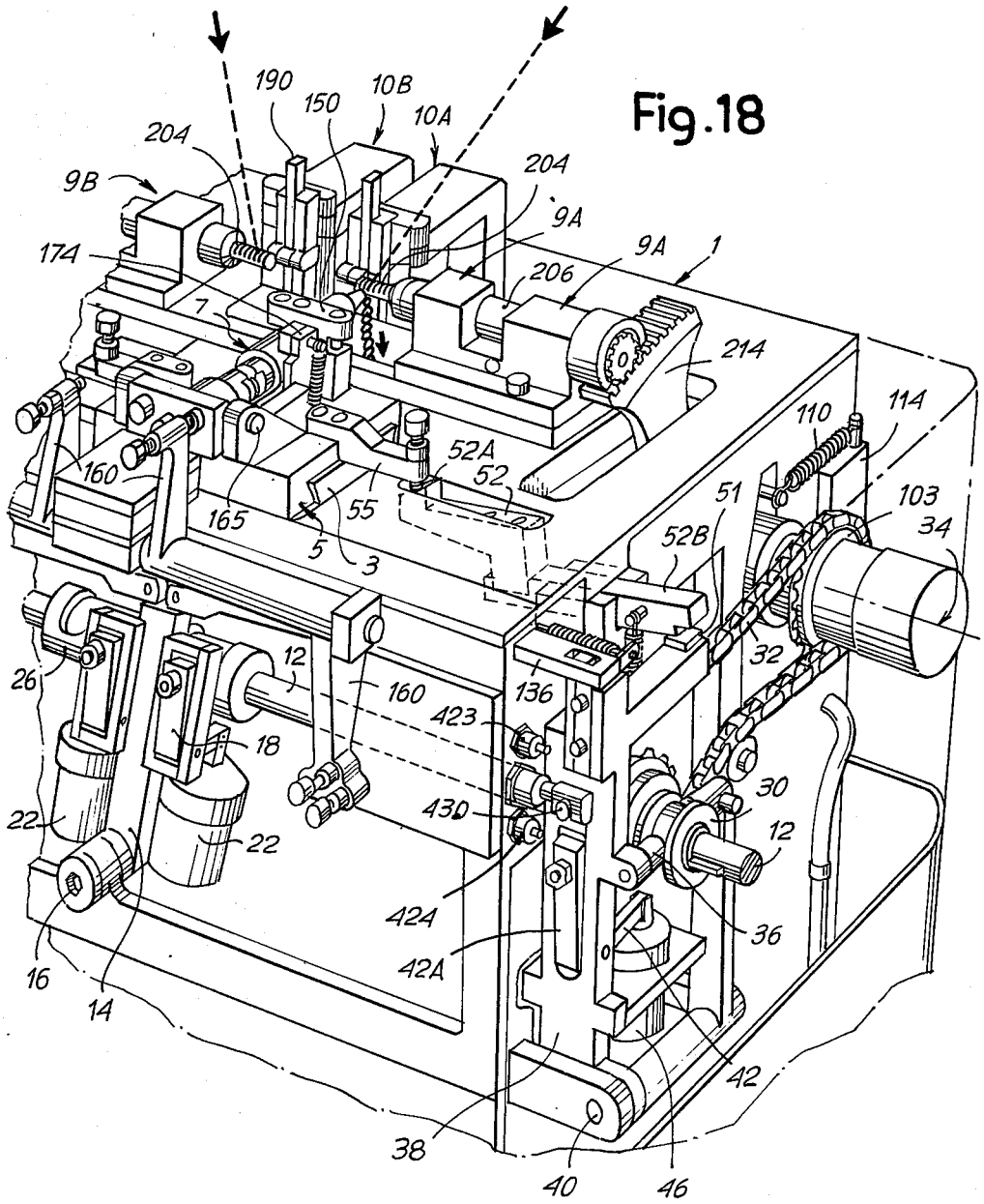
FIG. 18 illustrates an overall perspective view.
Figure 19:
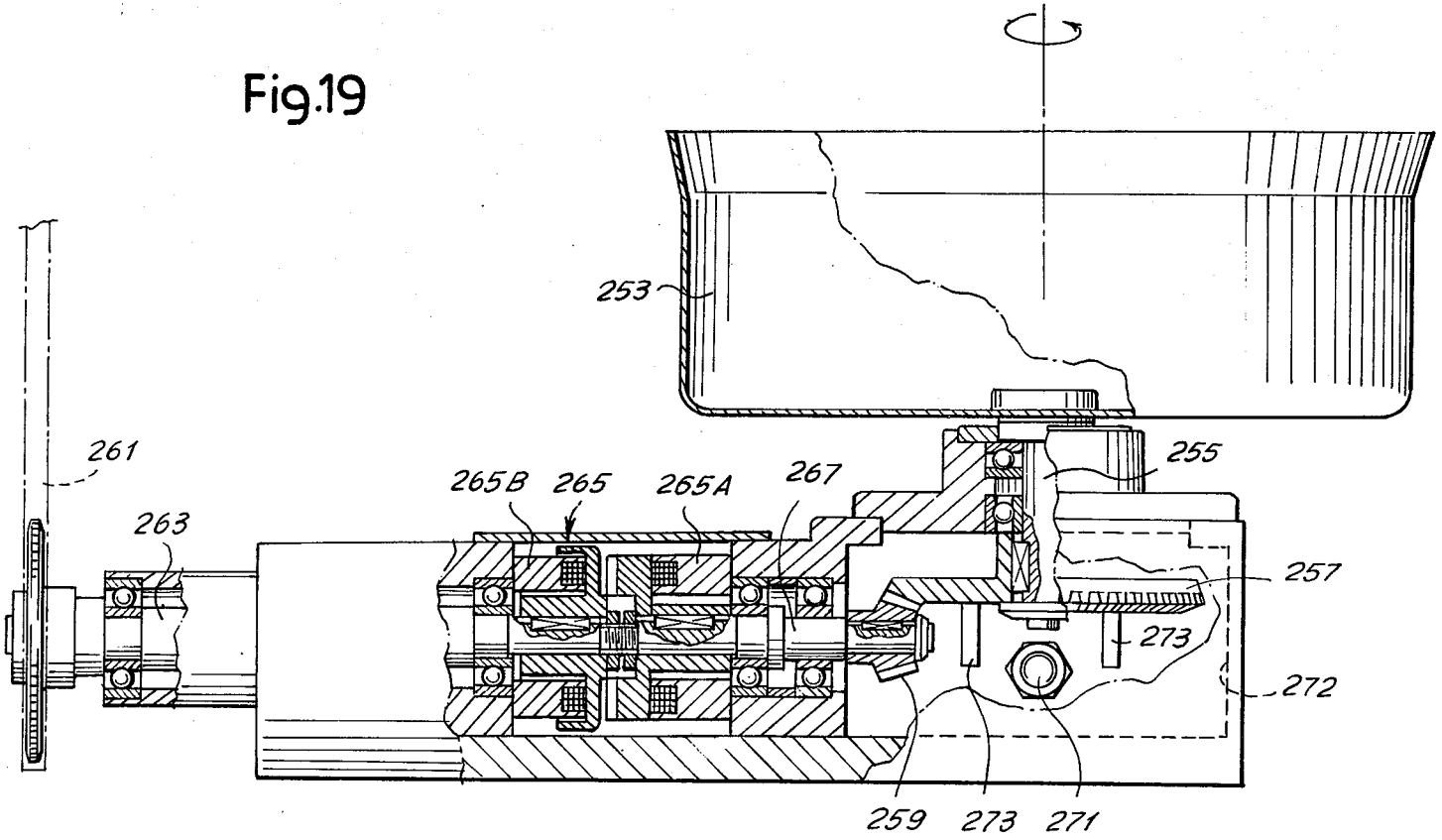
FIG. 19 illustrates a detail in a section, showing a system of rotational actuation of a container of the chain being formed.

Each of these levers 178 when in the intermediate position is pivoted—like other levers actuated by the cams of the semi-shafts 34 such as the levers 159 and 166—on a shaft 180 (see FIG. 11); at the end opposite the one forming the bracket 178A, each lever 178 carries a head 182 replaceable in an easy manner and including one or two or more cam tappets 182A. The heads 182 may be easily replaced; for instance, the head 182 may be replaced by a head 182X (FIG. 6); in this manner, while the head 182 is operated by two cams 234A and 234B, the head 182X may be operated by the two cams 234A and 234C; in this way, the law of control of the rotation of the pliers can be easily modified according to the profiles of the several cams alternatively arranged for the control of the levers 178 and thus of the rack 174 independently in each of the two positions in which the slide 5 and thus the rack 174 are located. The machine may be provided on one side and on the other side with two heads 182 equal to each other, or with different heads 182, according to the type of chain to be made. In fact, the rotation which is to be accomplished by the pliers 7 and thus by the jaws 150 thereof depends on the form of the chain link each time to be made; the chain links may be flat or twisted with an end at 90° with respect to the other, or twisted like "8" that is with one end twisted at 180° from the opposite one; examples of these chains are shown in the drawing; according to the program, it is necessary to modify the rotation of the pliers 7 and that is of the unit 162 and 172. The modification of the twist of the link is obtained by the replacement of the head 182 on the side of the wire feed of the respective link.

With the pliers 7, as already stated, two counter-pliers 10A and 10B are cooperating, said counter-pliers being of a per se operationally known type. Of these counter-pliers 190 denotes the fixed knives for the wire shearing or cutting, and 192 denotes the movable knives; the control of the knives is obtained by means of levers 194 linked to the stationary structure and operated by respective cams of the semi-shafts 34. Other levers 196 serve to actuate the movable means 198 of the respective second pliers, arranged to close the link and to deform it in cooperation with the jaws 150 of the pliers 7, when the latter are lowered and eventually caused to rotate.

Each of the feeder devices 9A and 9B of a per se known type includes a supporting structure 200, with respect to which a unit 202 may rotate and axially slide; this structure 200 carries at the inner end a helical tool 204 where the wire fed is advanced and deformed by means of a suitably shaped tool 205 borne by the shaft 202, in such a manner that the same wire is presented to the jaws 150 of the pliers 7 and thus to the tools of the corresponding counter-pliers 10A, 10B. A system to promptly lock the rotation of unit 202 is formed by a member 206, which is borne by the shaft and cooperates with a lever 208 operated by a cam of the respective semi-shaft 34. For the control of the angular and axial movement of the unit 202, there is provided an inclined front profile bush 210 designed to cooperate with the correspondingly shaped front surface of a geared pinion 212; this pinion is actuated by a geared sector 214 pivoted in 216 to the machine frame. The geared sector 214 is operated by a lateral roller tappet, designed to penetrate into the cam shaped groove or race 218A of a disc 218 borne always by each shaft 34; the cam 218A serves to operate in a prompt manner the advance or feed of the respective wire to be presented to the cutting members and operative for the forming of the link in a per se conventional way, when the pliers 7 are moved on the side of the considered sector 214.

As previously hinted, the machine may produce chains of different shapes, both of the flat type and of the twisted type, as it is particularly visible and given as an example in FIG. 20. It is known to those skilled in the art that, according to the flat or twisted form of the link, there are different requirements for the piling of the thus formed chain; in particular different requirements of piling appear alternatively in the machine when alternatively and subsequently the types of links each time formed, change.

In fact it is known that—in function of the forming of links of different types—it is necessary to determine a piling of the chain as it is formed with certain arrangements in order to avoid that the chain tends to be piled in an irregular manner and to get tangled up with the several links of the differentiated types with which the chain is formed. In practice it has been found necessary that the chain be piled in a flat container or other container arranged spaced under the working zone formed by the units such as 7, 9A, 9B, 10A, 10B; said container or flat shall be in conditions to rotate according to a vertical axis substantially passing through the intermediate position between the two opposite working positions, with an advance programmed in function of the programming of the links of different type with which the chain is gradually formed.

According to the drawing, there is provided a tray container 253 assembled in a rotary manner according to a vertical axis represented by a shaft 255, which lowerly presents a bevel gear rim 257 meshing with a bevel geared pinion 259 to form a reduction drive starting from a motor M, which actuates both the main shaft 12 in the upper section of the machine and—by means of a chain 261—the actuation means of the pinion 259. These means include a shaft 263 which is the drive shaft of a brake-clutch unit 265 designed to actuate a shaft 267 on which the geared pinion 259 is assembled. The brake-clutch system 265 is of the preferably electromechanical type and includes a braking or restricting clutch 265A and a proper friction clutch 265B actuated by the shaft 263. The control of the brake and clutch is subordinated to the program of the chain forming being produced effected at that time on the machine. For the stopping there may be arranged rather than a control on the program, a control in function of the movement effected by the same rotary unit 253, 255, 257; for this purpose there may be provided for instance a proximity switch 271 located laterally in respect of casing 272, in which the gear 257 is located, to cooperate with the one or the other of more extensions 273, which are mounted on the disc of the geared rim 257 and which are presented in front of the proximity switch 271 after having travelled along a certain length of the circular trajectory by effect of the rotation of the unit 254, 255, 257. For instance provisions may be made to determine the stopping after a fourth of a revolution or after a different fraction of a revolution of the unit 253, 255, 257, which is rotated at a very slow speed with respect to that with which the cycles of work of the machine members are actuated.

FIG. 20 shows some types of chains, for which different programs are required in relation to the movement of the collecting plate 253. In particular, for instance, for the chain denoted by A, it is necessary to provide for a rotation of the plate in the length indicated by a of the forming of the chain, while for the length b the plate must remain stationary. In the chain denoted by B the plate must be rotated in a continuous manner. In the chain denoted by C the plate must remain inactive. For the forming of the chain denoted by D, the plate shall rotate with a continuous motion. In general, when links of the flat type or links of the twisted type at 180° (like "8") as shown in E, are produced, the plate must rotate; when links of the twisted type at 90° are produced, the plate must remain inactive. Moreover the plate must remain stationary during the translation of the unit 5 and 7 from a position to another position. Anyway the programming of the control of the plate 253 is established in function of the working program of the machine for the production of the single chains and in function of the requirements of a regular lay in relation to what is effected by the machine and above all in relation to the presence of deformation by torsion or twist or of the absence of deformation of the single links. The control system is subsequently explained.

The machine includes a number of controls which are electric switches; some more important of said controls are hereinafter described and are visible in the drawing.

401 denotes a revolutions counter switch and thus designed to count the links formed by one of the semi-shafts 34; said switch 401 is actuated by a pin 403 borne by the periphery of the disc 218; on the other side there are provided similar elements 405 and 407. On the side of the disc 218 there is provided a control profile 409 which acts on a switch 410, which serves as a locking of the motor in case of misalignment upon the stopping of the corresponding semi-shaft 34; this switch also serves for the control of the plate 253, upon the consent of a manual exclusion and insertion control switch 412. Components 414 and 416 on the other side are similar to those denoted by 409 and 410.

In combination with each of the levers 38 there are provided three switches 418, 419, 420 controlled by feelers 421, 422 and respectively three switches 423, 424, 425, controlled by feelers 427 and 428; the feelers 421 and 427 are actuated by stems 430 combined with the respective fork levers 38.

Figure 5:
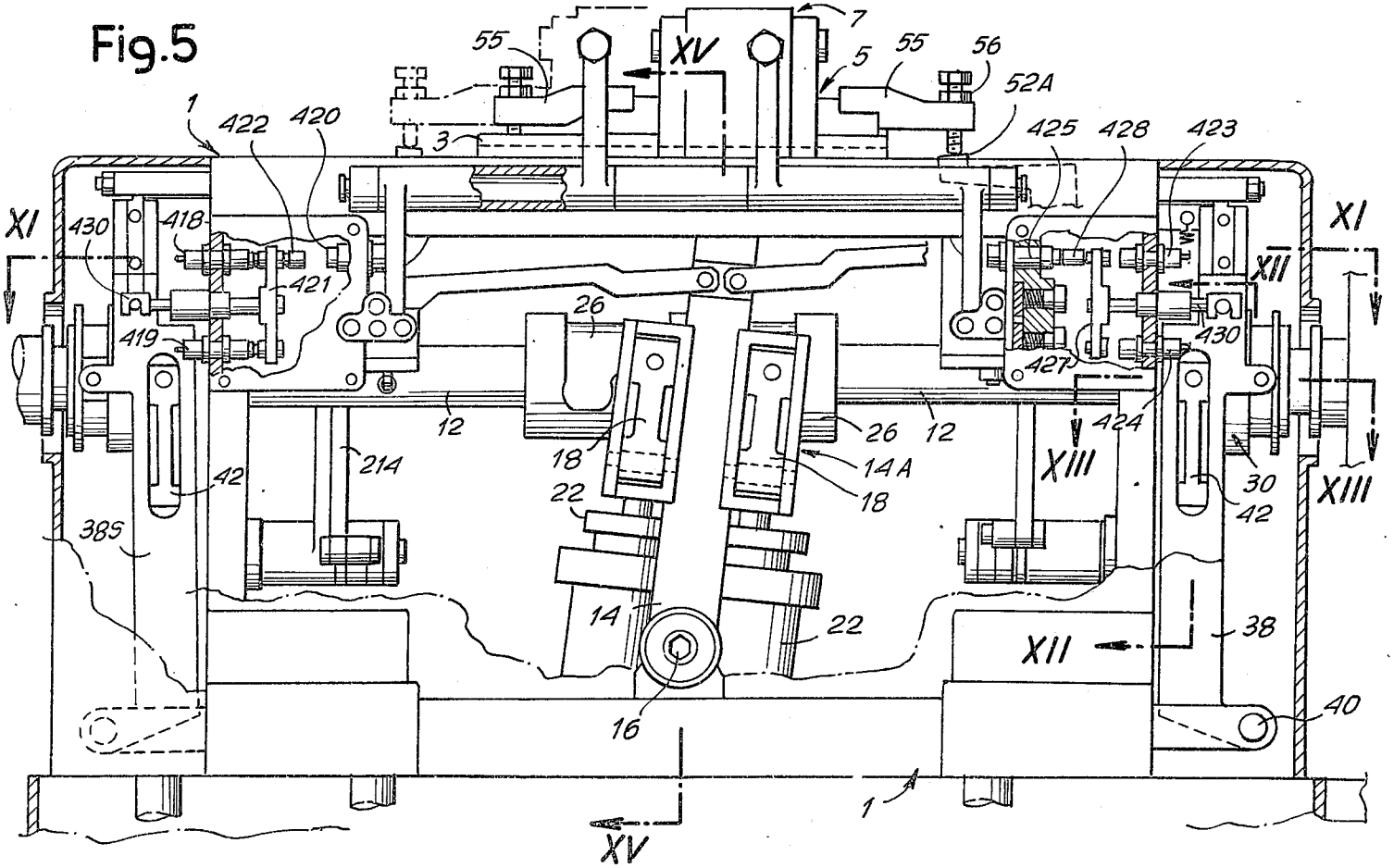
FIG. 5 is a partial view taken along the line V—V of FIG. 2, illustrating a detail of FIG. 1.
Figure 21:
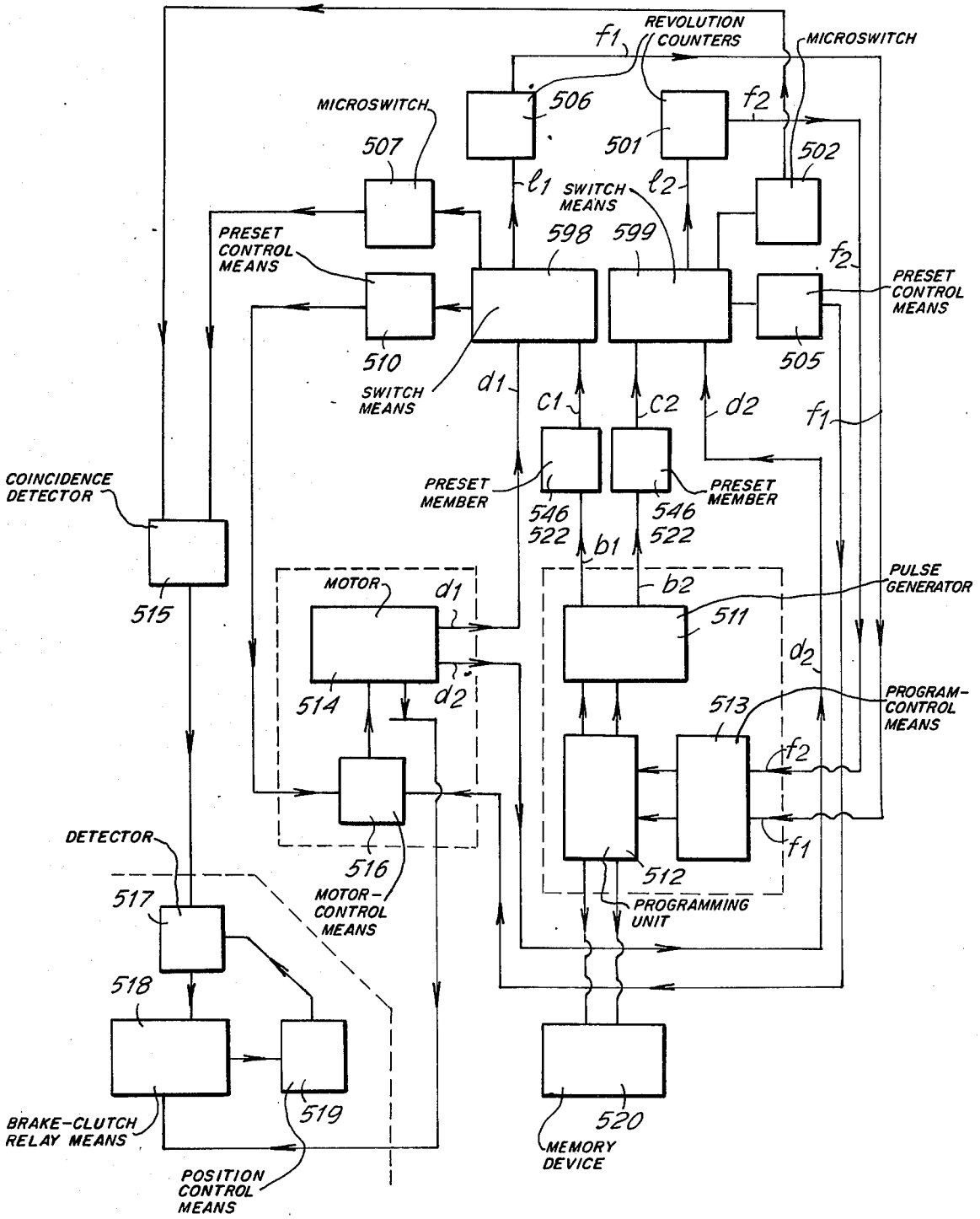
FIG. 21 illustrates a block diagram of a program combined with the machine.

FIG. 21 illustrates a block diagram for the setup of the program. 512 denotes the electronic programming unit; 511 shows a pulses generator; 546–522 indicate two preset members or units to carry out the program, which correspond practically to the electromagnets 46 and 22 on the two sides of the machine. 598 schematically denotes the detector members 418 and 419 and the respective fork lever 38 (active member) of the left hand side of the machine (see FIG. 5) and 510 denotes the preset control member—in practice the switch 420 —of the respective active member (lever 38); 599 shows the detector members 423 and 424 and the respective fork lever 38 (active member) of the right hand side of the machine, and 505 illustrates the respective preset control member—in practice the switch 425—of the active member (lever 38) of the right hand side. 501 and 506 are detectors of revolutions, that is the counters 401 and 405, whose data are supplied to the program control 513, 507 and 502 denote signal detectors represented by the two switches (in practice micro-switches) which correspond to the members 405 and 410, whose controls are subordinated to a consent member 515, represented by the switch 412. A detector 517 and a position control 519 for the collector plate 253 are represented by the switch 271 and pins 273, coordinated with the block 518 formed by the brake-clutch 265. 514 denotes the motor block and the block control member is indicated by 516.

When the unit relating to the above described block diagram is preset for a variable memory program, a memory 520 of the magnetic memory type or of the tape reading type or card type or the like can be coordinated with the programming unit 512.

Now reference is made to a summary of the operation.

Through the data of the bits counters (details 401, 403, 405, 407) i.e. of the blocks 501, 506, cooperating with the programming unit, instructions are given to the machine so that the desired alternation program may be accomplished by the machine. Considering the electronic operation departing from the start of the cycle in the right hand side of the machine, the operation is the following. Each revolution of the cams semi-shaft 34 (active member of the program 599) is signalled by means of the pin 403 projecting from the disc 218, which grazes the proximity microswitch 401 (revolutions detector 501). Upon accomplishing the last revolution of the set up program, detected by the control 513, the unit 512, 511 transmits a signal to the right hand external magnet 46 (block 546, 522) which becoming energized determines an angular movement of the corresponding small square lever 42, bringing into the working position the roller 48 arranged at the upper end of the same small lever 42. The cam 50, contacting the roller 48, determines the angular movement of the oscillatory lever 38, by which the release of the cams semi-shaft 34 in question takes place. Lever 38 is obliged to remain in the release position by the retaining system formed by the members 51–52B–52, already described.

The stopping of the semi-shaft 34 in the preset position is facilitated by the stopping group including the lever 105. In the movement the oscillatory fork lever 38 entrains the elements 430, 427, whereby the feelers on the cross-beam 427 approach the two proximity switches 423 and 424. In the same instant (also the cam semi-shaft 34 being stopped and thus also the control cam 218 of the sector integral thereto) the profile 409 located on the side of the cam 218 is positioned in correspondence of the proximity switch 410. The portion of circuit which concerns the energization of the translation control right hand magnet 22 is totally closed, by means of the switches 410, 423 and 424. The magnet 22 once energized determines the angular movement of the square lever 18 locating the roller 24, assembled in its upper end, in contact with the continuously rotating translation cam 26, which determines the movement of the lever 14 around the axis 16. The lever 14 is engaged with the slide 5 of the pliers unit 7, which is thus translated into the left hand working position (i.e. opposite the previous one). Once the translation has taken place, the release of the left hand oscillatory lever 38 is effected by means of the combined action of the members 56, 54, 52, 52A, 52B, 51, to let start with the clutch 30 the other semi-shaft 34. The left hand lever 38 in its movement, besides engaging the mechanism 30, which operates the hooking or engagement of the associated cams semi-shaft 34, urges the member 430—which is the left hand one—which bears the plate 421 with the feelers, to remove the signal from the switches 418, 420, which de-energize the right hand magnet 22, releasing the translation device involving the arm 14, from the cam 26.

It may happen that the translation is not accomplished in a complete manner whereby the one or the other of the proximity switches 425 or 420 intervene (according to the translation, if towards left or right) which have not been grazed by the feeler 428 or 422 if the lever 38 has not been released, whereby they automatically lock the motor.

The machine, as already described, is designed for the manufacture of chains with more combinations, as shown in the drawing as an example. Said combinations can be obtained by replacing a dowel 182 of the torsion lever 178, by other dowels (such as those denoted by 182X) having a similar form but which allow the lever to work on cams different from the previous ones, with the effect of operating the rotation of the pliers group 7 with different angles. The replacement of the dowels, as used on the present machine, may allow to obtain different links with the most various alternations. In order to avoid that the chain gets tangled as it falls into the collector, the already described device to advance or not the collecting container 253 has been provided. As the several combinations of links that can be produced by the machine, do not allow the same system of operation of the collecting device, it was necessary to be able to exclude or include partly or totally the movement of the same collector. For this purpose, the three-positions switch 412 has been provided (block 515) which allows the following: in a position "0" the machine makes chains of the form "C" always with links deformed at 90°, and the collecting device does not have to rotate owing to this conformation of the chain; in a position "1" the machine makes flat links always (form "B") or flat links alternated with links deformed at 180° that is like "8" (form "D") and the collecting device must rotate both when the machine operates on the right hand side and when it works on the left hand side; in a position "2" the machine makes links deformed at 90° and alternate flat links (form "A") or links deformed at 90° and "8" links, and the collecting device must rotate only when the portion of the machine, in which flat links or "8" links are produced, is operating, preferably the right hand side.

The rotation of the collector 253 is operated by the electromagnetic brake-clutch unit 265 (block 518), which receives the pulses from the same proximity switches 405 or 402 (blocks 502 or 507) which intervene in the setup of the machine program.

The electronic operation occurs as follows, starting from the time when the right hand cycle is interrupted. The pliers accomplish the translation and begin the cycle on the left hand arm; when at the end of the cycle, the cams shaft 34 is stopped and with said shaft also the control cam 218 of the sector 214, the dowel 409 located on the side of the same cam is in contact with the switch 410, which, besides allowing the energization of the magnet 22, emits a signal which arrives at the proximity switch 271. The control of the brake in order to stop the rotation of the collector is completed only when one of the pins 273 integral with the gear 257 passes in front of the switch 271 (blocks 517, 519). The stopping of the rotation of the collector 253 coincides perfectly with the stopping of the cams shaft 34 and with the start of the translation of the pliers unit 5, 7.

At the end of the translation the cycle opposite the previously affected cycle, is opened and the proximity switch 416, released from the respective dowel 414 of the control cam 218 of the left hand side sector, switches the signal from the brake to the clutch in the unit 265 and the plate 253 begins to rotate again up to the end of the cycle.

At the end of the cycle, the dowel 414 of the cam 218 is stopped above the switch 416, which will change the signal from the clutch to the brake of the unit 265, if this is allowed by the setup of the switch 412.

The operation, with reference to the block diagram, will now be described in more detail.

For instance one sets up a program—with the only counters and without a memory—which provides the forming of three links on the left and two links on the right, that is the program 3Y and 2X is set up. Once set the numbers on the programming unit 512, the machine is started with the device of the block 514. The number imposed on the right hand side (that is 2) is changed into a control pulse in the generator 511. This pulse is transferred by means of the bond $b_2$ to the preset device 546-522 which through the bond $d_2$ allows the program active member (represented by the whole right hand side of the machine, indicated in the diagram by 599) to begin and accomplish a cycle, being in this way controlled by the motor block 514 by means of the bond $d_2$. At the end of the cycle, the detector 401 (block 501) affected according to $l_2$ transmits a signal to the block 513 of control of the program, by means of the bond $f_2$, said signal being summed to eventual signals received previously (one for link) and compared with the number imposed in the corresponding portion of the programming unit 512. The cycle is repeated until the active member 599 has accomplished as many cycles as those imposed, or, better, its detector member 501 (the switch 401) has detected as many pulses which, summed in the program control 513, give a number equal to the imposed one.

Once attained this, always by means of the generator 511, the programming unit operates the left hand side through the bond $b_1$; it operates, that is, by means of $c_1$ the preset member 546-522—the left hand one—in order that the active member of the program 598 (left hand side of the machine) is operated, actuated by the block 514 by means of the bond $d_1$. In this case, the detector 506 affected by $l_1$, through the bond $f_1$, will forward to the program control 513 the pulses which will be summed and compared with those imposed in the corresponding portion of the programming unit 512. Then other cycles follow.

Should the machine not present its own active members regularly timed, this will be detected by preset control members 510 and 505, represented by the switches 420, 425, which will intervene on the control member of the block 516, which stops the motor block 514.

In case it is desired to make chains where the operation of the collecting unit, for instance for the right hand side, is required, the operation will take place according to the following scheme: in the active member 599, whose cycle begins operated as previously described, the detector 502 (represented by the microswitch 410) emits a signal which is intercepted or not by the consent member 515 (the switch 412) which on its turn forwards the signal to the additional detector and comparison member 517, formed by the proximity switch 271. Said member supplies its consent to the transmission through the block 518 (the group 265) if and only if certain reference members arranged in the block 519 (the pins 273) compare the signal emitted by the detector 517 in the positive direction.

The machine is arranged to set up, although maintaining the possibility of making chains with two different shapes and sizes, a combination of alternations higher than the two previously described.

Let us suppose to set up a cycle thus imposed: 1Y-2X; 1Y-3X; 2Y-4X.

Figure 2:
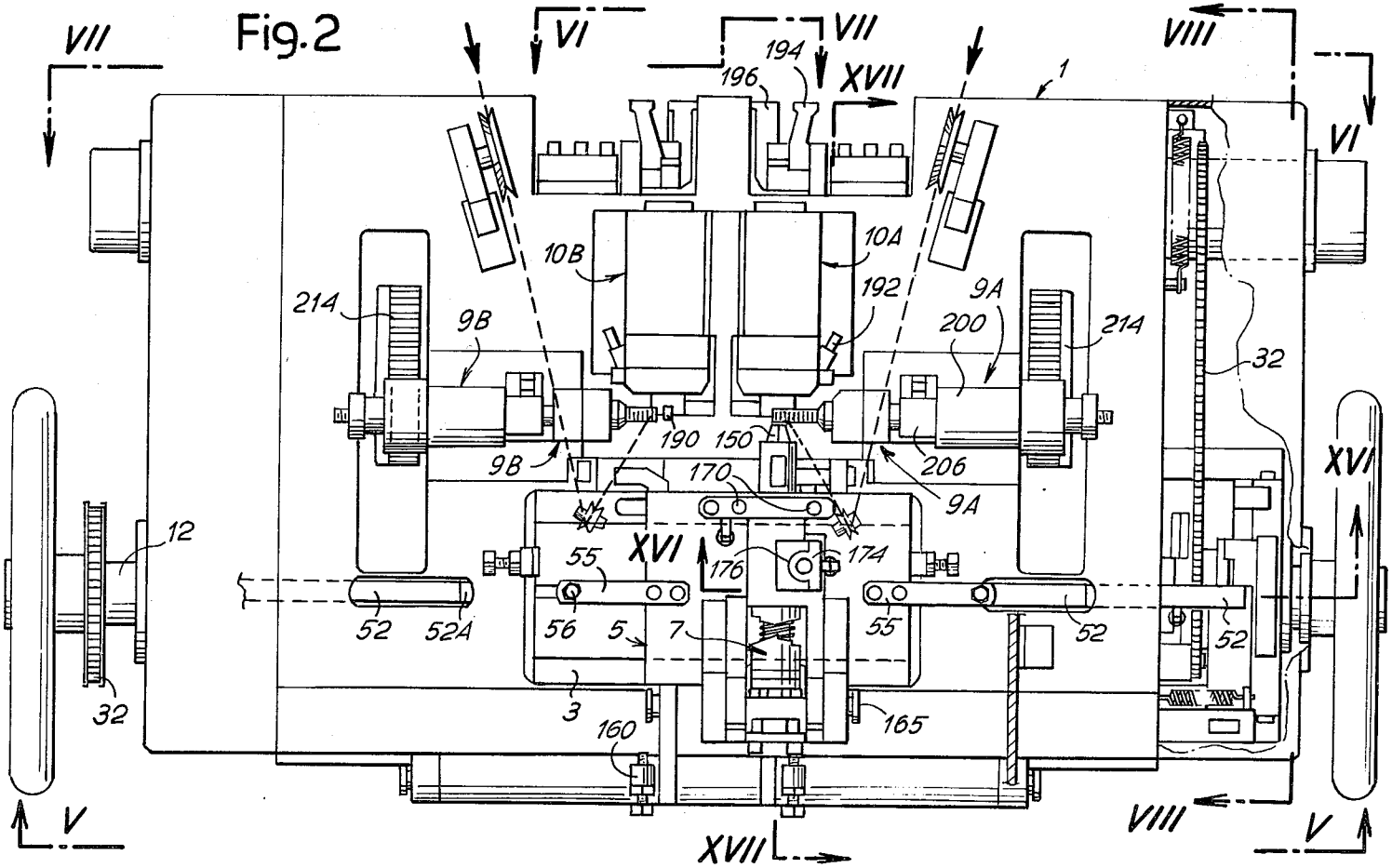
FIGS. 2, 3 and 4 illustrate a plan view taken along the line II—II of FIG. 1 and two enlarged details of FIG. 2.
Figure 3:
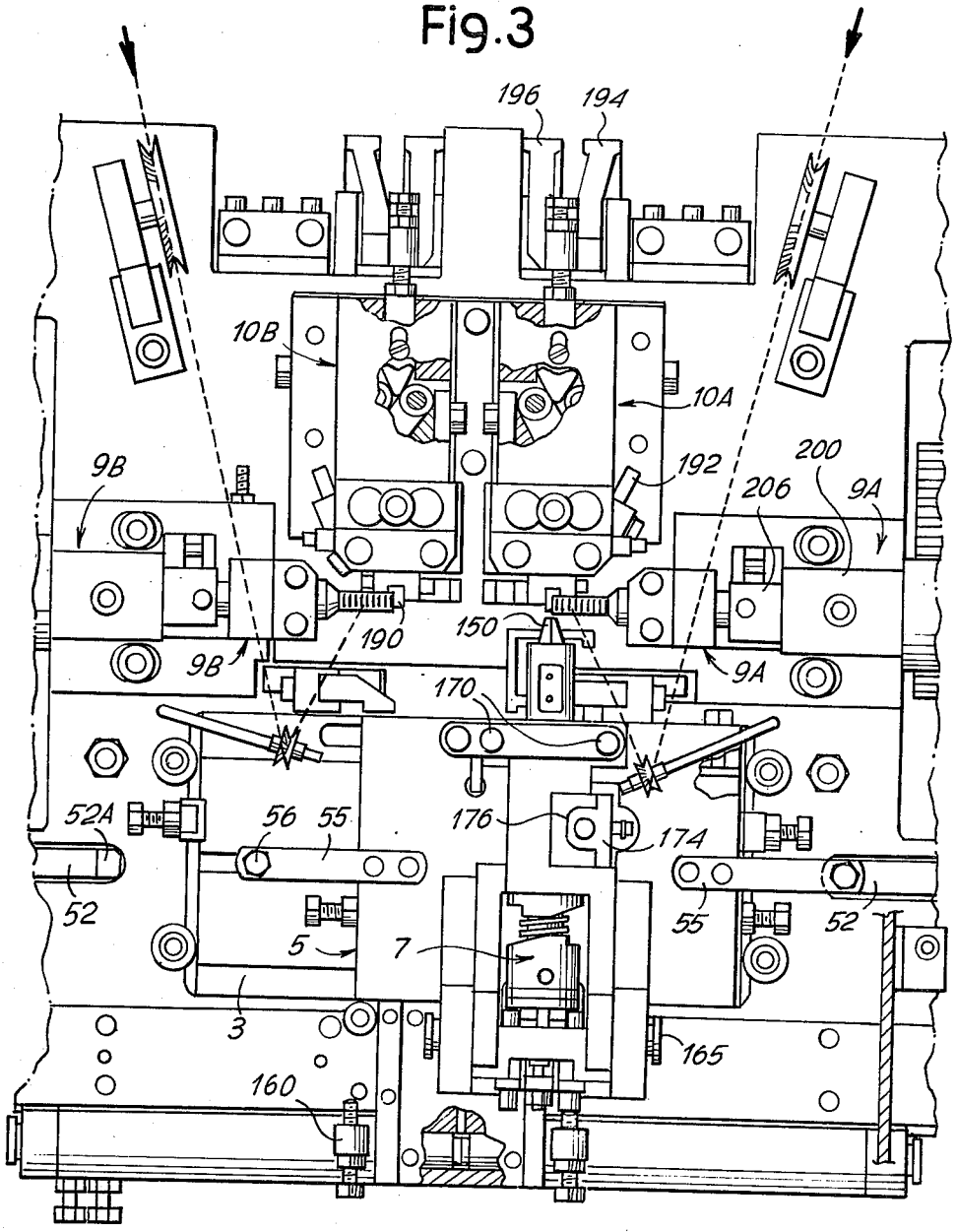
Figure 4:
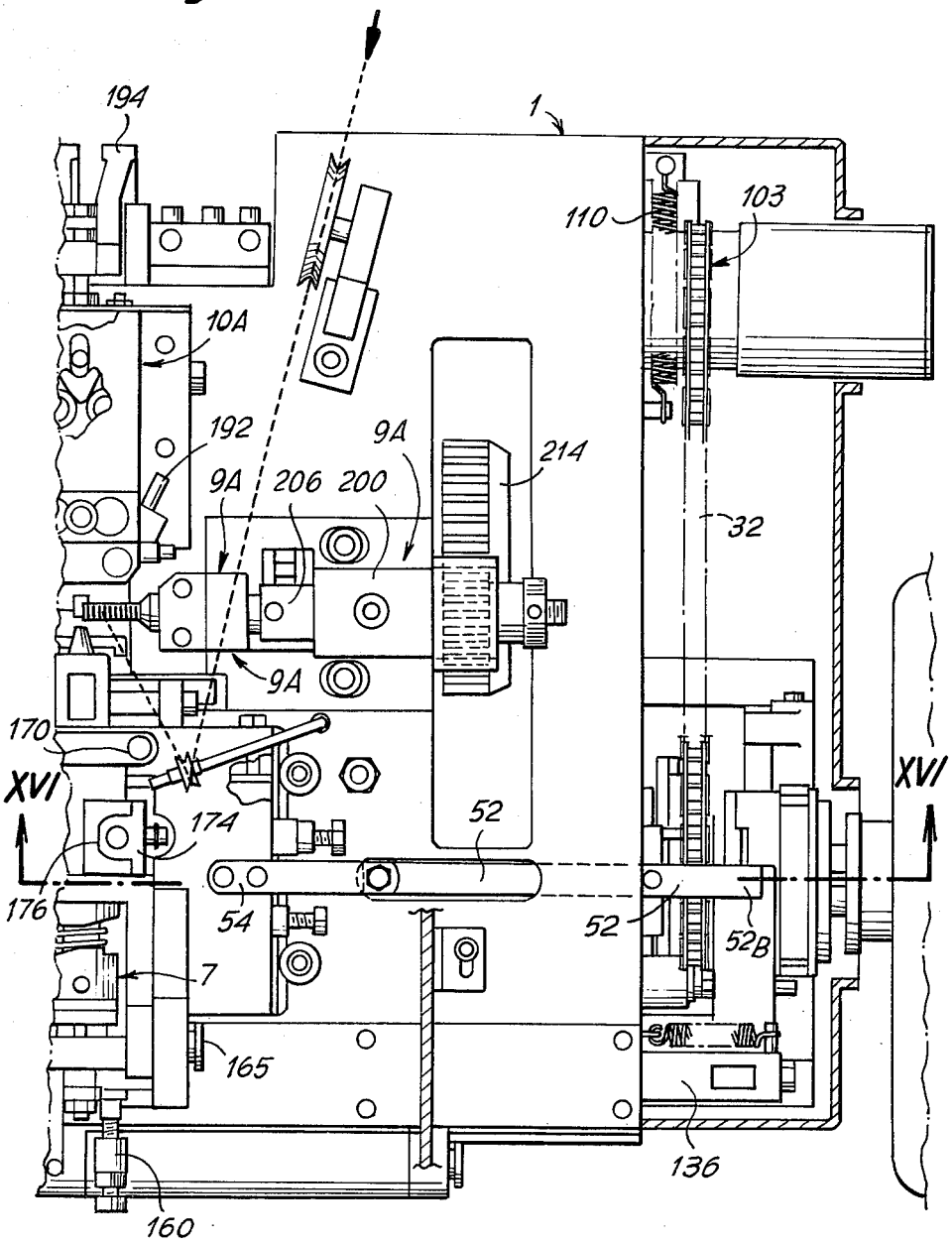

On the side of the programming unit 512 which operates the right hand arm of the machine, three preset members are inserted, on which the FIGS. 1, 1, 2 will be imposed, while in the left hand side of the programming unit 512 three preset members will be located, on which the FIGS. 2, 3, 4 will be imposed. Remaining invariable the concept of operation of the blocks, the preset members will be alternated in respect of one another as follows:

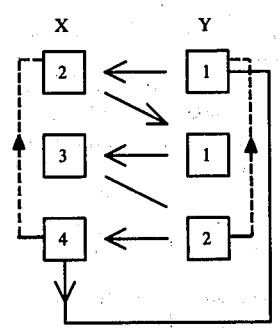

In case one desires to set up still more complex cycles, it is possible to replace the preset members of the portion X and the portion Y with two pulses receivers (one for each side) and upstream the programming unit 512 there is provided the "memory" block 520, in correlation with the same programming unit, so that one is able to insert variable and repeatable programs (equivalent, on the previous system, to the numbers marked on the preset members).

In order to obtain what stated, one locates in the memory—by means of magnetic support or tape reader (or card)—any program which is desired to be made, for instance: Y3-X2; Y1-X4; etc., that is with any desired number of pairs of values X and Y (left hand and right hand sides). After inserting said program in the memory block 520, the first two values of X and Y (in this case Y3-X2) are transmitted to the programming unit 512. At this point, the machine is started and carries out the portion of the program relating to Y3 in the previously described manner. Once finished the portion of the program relating to Y3, the programming unit 512 transmits the information of the effected program to the memory 520 (this while the machine is effecting the program for instance relating to X2, concerning the left hand section). The memory meanwhile replaces Y3 with Y1 in the programming unit in such a manner as to arrange the logic of the circuit for the setup of the subsequent left hand program.

This inter-exchange of information takes place to the end of the combinations imposed in the memory; the cycle, at this point, will be repeated again in the sequence Y3-X2; Y1-X4 etc. because, as described previously, as soon as the machine has effected the part of program relating to the last value of Y imposed, the memory replaces this value with the first value imposed by Y (in this case Y=3).

It is intended that the drawing only illustrates an embodiment given only as a practical demonstration of the invention, said invention being in conditions as to be varied in the forms and arrangements without however departing from the scope of the concept which informs the same invention.

I claim:

1. In a machine for forming decorative chains having links of two shapes and/or sizes, obtainable according to a modifiable program, involving two feeder units for feeding independent supplies of wire-like material, and a pliers unit adapted to cooperate alternatively with one or the other of said feeder units, the improvement in which each feeder unit includes its own associated counter-pliers system and in which a pliers unit is reciprocably movable between two spaced positions of independent cooperation with one or the other of the respective counter-pliers systems, double-acting actuating means for imparting to said pliers unit a reciprocable displacement into a selected one or the other of said positions, a main camshaft and means for continuously driving the same, first selectively operable means for operatively connecting said camshaft to said actuating means to displace said pliers unit to one of said positions, second selectively operable means for operatively connecting said camshaft to said actuating means to displace said pliers unit to the other of said positions, each counter-pliers system including its own camshaft for counter-pliers actuation, a separate drive connection from said main camshaft to each of said counter-pliers camshafts, each said drive connection including an independently actuable clutch, means responsive to plier-unit displacement to one of said positions for actuating the clutch associated with the cooperating counter-pliers for said one position, and means responsive to pliers-unit displacement to the other of said positions for actuating the clutch associated with the cooperating counter-pliers for said other position.

2. The improvement of claim 1, in which each of selectively operable means of said double-acting actuating means is electrically operated.

3. The improvement of claim 1, in which said pliers unit is slide-mounted and guided for longitudinal displacement from one to the other of said positions.

4. The improvement of claim 1, in which said double-acting means includes an actuating lever fixedly pivoted at one end and operatively connected at the other end for displacement of said pliers unit, first and second solenoid-positionable cam followers carried by said lever at a location intermediate the ends of said lever, a left-to-right displacement cam on said main camshaft in proximity to one of said cam followers, and a right-to-left displacement cam on said main camshaft in proximity to the other of said cam followers, said first and second selectively operable means being electrical and operatively connected to the respective solenoids of said cam followers.

5. The improvement of claim 1, in which fixedly referenced stop means associated with each counter-pliers camshaft determines a fixed counter-pliers-camshaft angle at which the counter-pliers camshaft is arrested upon associated clutch disengagement.

6. The improvement of claim 1, and including a programmable sequence control means with recycling memory, and including output-control connections to said first and second selectively operable means, and means synchronizing the advance of the program of said control means in accordance with the link-forming cycles of said main camshaft.

7. The improvement of claim 1, in which adjacent each displacement position of said pliers unit engaged latch elements hold the associated clutch in disengaged position against the bias of a spring, and latch-disengaging means carried with said pliers unit and operative to disengage the latch elements associated with one clutch upon displacement to one of said positions and to disengage the latch elements associated with the other clutch upon displacement to the other of said positions.

8. The improvement of claim 7, in which latch-resetting means operatively associated with said main camshaft at locations corresponding to each of said positions is operative to reset the associated latch elements to their engaged relation for holding a disengaged condition of the associated clutch upon pliers-unit displacement in the direction away from the previously engaged associated clutch.

9. The improvement of claim 1, in which each of said clutches is a dog clutch involving but one angular position of main-camshaft engagement for each revolution of said main camshaft whereby a cycle of associated counter-pliers operation is in predetermined phase relation to a cycle of the main camshaft.

10. The improvement of claim 1, in which the reciprocable displacement of said pliers unit is horizontal, between said two positions, said pliers unit including a pliers head by which the most-recently formed link of a chain of links is held in position for connection to the new link which is being formed by the particular counter-pliers system at which it has been positioned for cooperation, the link-holding portion of said head being generally vertically downwardly clear of other parts of the machine, and an upwardly open cupped container supported for rotation beneath said pliers head and on a vertical axis passing between said two positions.

11. The improvement of claim 10, in which intermittent-drive means are connected for imparting intermittent unidirectional relatively slow rotation to said container about said vertical axis.

12. The improvement of claim 11, in which said intermittent-drive means includes a pick-off connection to said means for driving the main camshaft.

13. The improvement of claim 12, in which said intermittent-drive means includes electromagnetic clutch and brake elements and means for exciting the same in alternation.

14. The improvement of claim 13, in which said last-defined means includes a fixed switch element and a plurality of switch-actuating lug elements at equal angular spacings about the container axis, said clutch and brake elements being actuated in alternation by successive lug elements to determine intermittent lug-to-lug container displacements.

15. The improvement of claim 1, in which at least one of said counter-pliers systems includes a replaceable head element in conjunction with one of several cam-follower lever systems tracking the respective cams of its associated counter-pliers camshaft, said replaceable head element permitting associated lever modification in accordance with particular head-element replacement, for selective modification of the link-forming function performed by the lever system in which the head replacement is made.

16. The improvement of claim 15, in which said one lever system includes a rocker arm carrying the replaceable head at one end, said head having two tappets respectively positioned for cooperation with two different cams on the associated counter-pliers camshaft.

17. The improvement of claim 15, in which each of said counter-pliers systems has at least one cam-follower lever system which is adapted for interchangeable accommodation of the same replaceable head element.

* * * * *